US005296166A

United States Patent [19]

Leong

[11] Patent Number: 5,296,166

[45] Date of Patent: Mar. 22, 1994

[54] METHOD OF MANUFACTURING EMULSIONS

[76] Inventor: Jerry Leong, 23515 Naffa Ave., Carson, Calif. 90745-5735

[21] Appl. No.: 338,292

[22] Filed: Apr. 14, 1989

Related U.S. Application Data

[63] Continuation-in-part of Ser. No. 17,779, Apr. 10, 1987, abandoned.

[51] Int. Cl.[5] ..... B01F 3/08

[52] U.S. Cl. ..... 252/314; 252/309

[58] Field of Search ..... 424/81; 252/304, 315, 252/363.5, 315.01, 308, 314, 309

[56] References Cited

U.S. PATENT DOCUMENTS

| | | | |
|---|---|---|---|
| 2,798,053 | 7/1957 | Brown | 252/174.24 X |
| 3,146,170 | 8/1964 | Battista | 167/85 |
| 3,282,874 | 11/1966 | Friedrich et al. | 252/72 X |
| 3,919,411 | 11/1975 | Glass et al. | 424/81 |
| 3,920,811 | 11/1975 | Lund | 424/81 X |
| 4,102,995 | 7/1978 | Hebborn | 424/81 |
| 4,368,187 | 1/1983 | Flom et al. | 424/81 |
| 4,431,632 | 2/1984 | Burns | 424/81 |
| 4,481,186 | 11/1984 | Deckner | 424/59 |
| 4,514,385 | 4/1985 | Damani et al. | 424/81 |
| 4,514,386 | 4/1985 | Yamahira et al. | 424/81 |
| 4,566,977 | 1/1986 | Hatfield | 252/363.5 X |
| 4,738,842 | 4/1988 | Dow et al. | 424/81 |
| 4,956,170 | 9/1990 | Lee | 424/81 |

FOREIGN PATENT DOCUMENTS

| | | | |
|---|---|---|---|
| 1548837 | 7/1979 | United Kingdom | 424/81 |

OTHER PUBLICATIONS

Bennett, ed. The Chemical Formulary, NY Chemical Publishing Co., 1983, pp. 130–131.

*Primary Examiner*—Gary Geist

*Attorney, Agent, or Firm*—Charles H. Thomas

[57] ABSTRACT

Emulsions of a water immiscible phase in an aqueous phase are produced with an improved method which does not require milling or homogenizing equipment and which allows emulsification to be carried out at reduced temperatures. A hydrophilic thickening agent component is dispersed within an oil or wax phase prior to addition of the oil or wax phase to an aqueous phase. When the oil or wax phase is added to the aqueous phase, phase inversion and gellation occur and the thickening agent forms a lattice which entraps oil or wax phase particles of reduced size in a uniform dispersion. The temperature of the emulsion is reduced until the oil or wax particles begin to solidify.

15 Claims, No Drawings

METHOD OF MANUFACTURING EMULSIONS

The present application is a continuation-in-part of U.S. application Ser. No. 017,779 filed Apr. 10, 1987 now abandoned.

BACKGROUND OF THE INVENTION

1. Field of the Invention

The present invention relates to an improved method of manufacturing emulsions of a water immiscible phase in an aqueous phase. Emulsions of this type are widely employed in the cosmetic and toiletry industries.

2. Description of the Prior Art

Cosmetic and toiletry creams and lotions are widely manufactured as emulsions of a water immiscible phase in an aqueous phase. In order to finally disperse particles of the water immiscible phase in the aqueous phase, substantial amounts of an emulsifier are employed according to conventional manufacturing techniques. Suitable emulsifiers are rather expensive and represent a considerable portion of the cost of the emulsion product. Also, emulsifiers do represent a skin irritant in the emulsion product.

Furthermore, with conventional manufacturing techniques which rely upon emulsifiers to disperse an oil phase within an aqueous phase, emulsification is usually carried out at an elevated temperature of perhaps 70 to 80 degrees Celsius. Many of the components of cosmetic and toiletry emulsions, such as perfume oils, are sensitive to temperature. Such temperature sensitive materials exhibit a loss of activity when subjected to the relatively high temperatures employed in conventional emulsification manufacturing techniques. As a consequence, relatively large quantities of these heat sensitive materials are required in the products to compensate for the loss of activity caused by subjecting them to elevated temperatures.

A further disadvantage of conventional emulsification techniques is that, due to the relatively high temperatures employed, a considerable time is required for the emulsified product to be cooled. This increases the labor cost for each batch of materials and reduces the throughput period. That is, the cooling time represents a limiting factor on the number of batches of product which can be produced with available equipment.

As used herein, an emulsifier is considered to be a substance which lowers surface tension only for the purpose of promoting emulsification, as contrasted with the broader term surfactant which applies to substances which lower surface tension for other purposes as well. For example, methyl paraben is a surfactant but is not an emulsifier.

SUMMARY OF THE INVENTION

The present invention represents a novel alternative to conventional techniques for manufacturing emulsifications. According to the present invention, only a relatively small amount of an emulsifier is employed. Conventional manufacturing techniques are based upon the premise that the emulsifier is responsible for holding an oil and wax phase in a finely divided suspension in a water phase of an emulsion. However, it has been discovered according to the invention that once the oil and wax phase solidifies, the oil and wax particles will not recombine, but instead will be held in a finely divided suspension provided that a suitable thickening agent is employed. According to the manufacturing method of the invention, a quantity of emulsifier just sufficient to disperse the thickener (or a neutralizing agent component of a multicomponent thickener) is employed in preparing the oil and wax phase. The ratio of the weight of the emulsifier to that of the thickener is no greater than about 0.50 to 1 and preferably is no greater than about 0.35 to 1. When the oil and wax phase is then added to the aqueous phase, the thickener forms a lattice about finely dispersed particles of oil and wax. Moreover, as the emulsion is cooled, the oil or wax particles solidify, and thus reinforce the lattice structure.

By employing a thickener along with a relatively small amount of emulsifier in the oil and wax phase, the water immiscible oil and wax phase can be mixed with only low shear mixing to produce a much finer dispersion more rapidly as contrasted with conventional techniques. Furthermore, because only low shear mixing is employed in accordance with the invention, homogenization and the use of milling machines are unnecessary.

High shear mixing is mixing which either produces a temperature increase of at least ten degrees Centigrade, or mixing which produces a pressure on the emulsion of at least 500 pounds per square inch. Low shear mixing is mixing which produces neither of the characteristics of high shear mixing. That is, if any temperature increase results during low shear mixing, it is limited to an increase of less than ten degrees Celsius. Also, low shear mixing is performed at a pressure of less than 500 pounds per square inch.

The distinction between high shear and low shear mixing may be further delineated by reference to the descriptions of conventional emulsification mixing equipment which is found in the book "Cosmetics and Technology", Second Edition, Vol. 3, edited by M. S. Balsam and Edward Sagarin, and published by John Wiley and Sons, from pages 611 to 617. Specifically, low shear mixing includes hand stirring, aeration, planetary stirring, propeller agitation and turbine agitation. In hand stirring the emulsion is merely subjected to manually mixing with an implement which is typically shaped in the form of a paddle. In aeration air, gas or vapor is bubbled through an emulsion to be mixed. In a planetary stirrer a paddle is rotated about its own axis, and is also moved in a circular orbit upon the center of a mixing container. In propeller agitation one or more propellers are mounted on one or more propeller shafts in a mixing tank, and the propellers are rotated about the axes of the shaft upon which they are mounted. Propellers such as these are also employed in turbine agitation, which differs from propeller agitation by the inclusion of fixed baffles on either the wall of the mixing container or adjacent to the propellers While the equipment employed in hand stirring, aeration, planetary stirring, propeller agitation and turbine agitation will vary widely with the application and the emulsion to be mixed, these mixing techniques typically produce a temperature increase that is less than ten degree Celsius and subject the emulsion to a pressure of less than 500 pounds per square inch. Consequently, these mixing techniques may be considered to be those processes that achieve low shear mixing.

In contrast, high shear mixing is typically carried out with a colloid mill, a homogenizer, or a high frequency oscillator, which may be an ultrasonic oscillator. A colloid mill typically employs a rotor having rotor blades which move at high speed relative to a stator formed by fixed walls of a mixing cavity. The clearance between the rotor and stator in a colloid mill is normally no greater than a few thousands of an inch. The emulsion to be mixed is typically forced toward the rotor in a path coaxial with the axis of rotation of the rotor. The emulsion meets the end of the rotor at an angle normal to the plane of the rotor end face, and is forced laterally and at an angle into the interstitial clearance space between the rotor and the stator, which is normally between only about 0.001 and 0.005 inches. Because of the high friction to which the emulsion is subjected in passing between the rotor and the stator, a temperature increase in the emulsion of between about 10 degrees and 55 degrees Celsius occurs.

Emulsification is achieved in a homogenizer by forcing the continuous and discontinuous phases together past a spring biased valve. The spring which acts upon the valve normally exerts a pressure at the valve seat of from about 500 to 3,000 or more pounds per square inch. Emulsion occurs as the phases flow past the valve seat. A high frequency or ultrasonic oscillator also subjects the emulsion to a high pressure. One such ultrasonic frequency device which is employed for mixing emulsions is the Pohlman whistle which is described in "Harry's Cosmeticology", Sixth Edition, by Ralph G. Harry, at pages 737–739.

Emulsions which are mixed with a colloid mill, a homogenizer, or with high frequency or ultrasonic mixing are typically subjected to temperature increases of at least ten degrees Celsius or pressures of at least 500 pounds per square inch, or both. Consequently, such devices are considered to be those which effectuate high shear mixing.

High shear mixing has the very significant disadvantage of raising the temperature of an emulsion which must subsequently be cooled. In the batch processing of emulsions to produce cosmetic products, the time required to cool the emulsion is directly proportional to the temperature at which the emulsion is raised during mixing. Consequently, if emulsification can be carried out at lower temperatures which are characteristic of low shear mixing, less time is required to cool the emulsion so that the emulsion product can be removed from the mixing equipment and packaged in far less time than is possible with manufacturing techniques which employ high shear mixing.

Another problem that exists in high shear mixing is that the high shear mixing equipment must be torn down and cleaned after mixing each batch of emulsified product, since that product will otherwise clog the very small clearances in high shear mixing machinery. Also, this equipment teardown is recommended for compliance with good manufacturing procedures to minimize cross-contamination of products. This further increases the time and expense involved in producing emulsions with high shear mixing techniques. However, high shear mixing or high emulsifier content has heretofore been considered necessary in phase inversion techniques in order to achieve sufficiently fine dispersion in the resultant emulsion product.

The method of the invention is dependent on the phase inversion which takes place during emulsification. The method employs a thickener which may be either a single component thickening agent, or a thickening agent formed of a plurality of mutually reactive components. Suitable multiple part thickening agent systems include carbomers which are combined with alkaline neutralizing agents. When thickening agents or thickening agent components have been emulsified or dispersed in the oil phase, there is a rapid inversion of the emulsion upon the sudden combination with excess aqueous phase. As a result, an emulsion is produced in which the water immiscible components of the oil phase are suddenly inside droplets which are dispersed within the aqueous phase. The rapid phase inversion also results in an emulsion product which has finely divided droplets of oil without high shear mixing.

Only a relatively small amount of thickener is employed according to the process of the invention. The weight of the thickener in the total weight of all constituents that are present at the time emulsification occurs is no greater than 2.5 percent. In the production of some emulsion products additional emulsifier is added after phase inversion occurs. However, this additional emulsifier plays no part in the phase inversion process and does not interact with the emulsifier during phase inversion.

Because the amount of emulsifier required by the process to emulsify substantial quantities of the oil and wax phase is minimized, the resulting emulsion is less susceptible to being readily washed off with water. The products produced according to the invention will not easily wash off in plain water and are neither greasy, heavy nor sticky.

One object of the method of the invention is to decrease the emulsification temperature required to produce suitable emulsions. As a result, savings in heating and cooling costs as well as savings in time and labor are realized.

A further object of the method of the invention is to reduce the extent to which the emulsion product is an irritant by decreasing the amount of emulsifier in the product.

Yet another object of the invention is to lower the risk of preservative deactivation which is caused by nonionic emulsifiers.

Another object of the invention is to produce an emulsion product of improved stability. If the droplets of the oil phase solidify upon cooling to room temperature, they will not reagglomerate. Since the droplets are no longer fluid under such conditions, they increase the emulsion stability by reinforcing the gel matrix due to the noncompressibility of the solid particles under normal conditions.

A further object of the invention is to reduce the manufacturing costs of emulsion products, such as cosmetic creams, by removing the need for high shear mixing to reduce particle size in the oil phase. The emulsification process of the invention can utilize the phase inversion properties of thickeners such as xanthan gum, hydroxypropyl methylcellulose, etc. to enable a product to be produced using low shear techniques that produce less than a 10 degree Celsius temperature rise and are carried out at pressures less than 500 pounds per square inch.

By lowering the emulsification temperature and eliminating the need for high shear mixing, the turnover time is decreased. That is, the minimum time to which specified equipment must be dedicated to the production of a given quantity of a specific product is reduced. This reduces the overhead loading cost attributable to the manufacturing equipment, which is a fixed, overhead cost, by increasing the quantity of material which may be produced using the same equipment over a given period of time. As a direct result, the profitability of producing a given emulsion product is improved.

Yet another object of the invention is to lower the material cost of the emulsion product by decreasing the amount of emulsifier in the product. The material cost savings achieved with the invention can be substantial. Since the quantity of emulsifier is decreased, the amount of oil phase required to obtain a product which is both water resistant and cosmetically elegant can be decreased to a level less than 10 percent of the total product weight. This leaves a possible water content of over 90 percent while producing a product which is cheaper and less irritating than products currently manufactured according to existing techniques.

Another object of the invention is to allow the production of emulsions containing a plurality of discontinuous phases which are normally considered incompatible. That is, such incompatible discontinuous phases may contain materials which are mutually reactive. For example, a perfume oil may be microencapsulated but could not be used in an emulsion product previously due to affinity of the perfume oil for the oil phase. By inclusion of microencapsulated perfume oil in an emulsion it is possible to produce a cream or lotion perfume with the properties of both a moisturizer and a concentrated fragrance product.

A further extension would be the inclusion of pharmacologically active ingredients in microencapsulated form to the emulsion to improve the application of the drug. Another benefit is that since minimal quantities of emulsifier are used there is minimal interaction of the microencapsulated material with the emulsifier.

In one broad aspect the present invention may be considered to be a method of manufacturing emulsions comprising forming a liquid discontinuous phase emulsion constituent by mixing together into a uniform dispersion quantities of an emulsifier, an oil which is immiscible in water, and at least one component of a hydrophilic colloid thickener, wherein the ratio of the weight of the emulsifier to that of the thickener is no greater than about 0.50 to 1 and wherein the weight of the thickener in the total weight of all constituents prior to phase inversion is no greater than 2.5 percent. This discontinuous phase emulsion constituent is combined with a liquid continuous phase emulsion constituent that includes water while mixing the discontinuous and continuous phase constituents together at least until the occurrence of a phase inversion and until the thickener gels to stabilize an emulsion.

In another broad aspect the invention may be considered to be a method of manufacturing emulsions of a water immiscible phase in an aqueous phase comprising: liquefying a component which is immiscible in an aqueous phase and adding thereto a hydrophilic thickening agent component, and a nonionic emulsifier to the extent of a maximum of about 50 percent by weight of the thickening agent component, wherein the weight of the thickening agent component in the total weight of all constituents of both the water immiscible phase and the aqueous phase is no greater than 2.5 percent, and dispersing the thickening agent component and the emulsifier within the component which is immiscible in the aqueous phase to form the water immiscible phase. The aqueous phase is liquefied, and both the water immiscible phase and the aqueous phase are mixed with low shear while combining the water immiscible phase with the aqueous phase until phase inversion and gellation occur. Low shear mixing of the phases together is continued while reducing the temperature thereof at least until the water immiscible phase begins to solidify within the aqueous phase.

In another more specific aspect the invention may be considered to be, in a method of manufacturing a cream, such as a cosmetic cream, having a water immiscible phase dispersed within an aqueous phase, the improvement comprising separately preparing the water immiscible phase and the aqueous phase wherein the preparation of the water immiscible phase includes forming a uniform liquid dispersion of quantities of an emulsifier, a component which is immiscible in the aqueous phase, and at least one component of a hydrophilic thickener, wherein the ratio of the emulsifier to that of the thickener is no greater than about 0.50 to 1 and wherein the weight of the thickener in the total weight of all constituents is no greater than 2.5 percent. The water immiscible phase is combined with the aqueous phase while concurrently mixing the water immiscible and aqueous phases together with low shear until phase inversion occurs and the thickener gels. It is to be understood that this weight limitation on the thickener applies only prior to emulsification or phase inversion, as it may be desirable to add additional emulsifier once emulsification has been carried out.

Following emulsification of materials in the product once the phases are combined, the product is generally cooled. If a batch of the product is cooled at a steady rate where the rate of temperature decreases relative to time is constant, then the viscosity of the product will increase gradually until a critical temperature is reached. At the critical temperature, the discontinuous phase begins to solidify. As it solidifies the then solid particles of the discontinuous phase begin to support the lattice structure of the colloid thickening agent which in effect reinforces and strengthens the gel. At this point, the rate of change of viscosity relative to change in temperature greatly increases.

The terminology employed in connection with the description of the invention is consistent with the definitions found in the Cosmetic Toiletries and Fragrances Association (CTFA) Ingredient Dictionary, Third Edition. In this connection the aqueous phase of an emulsion is sometimes termed an external, or continuous phase. The oil or wax phase, on the other hand, is sometimes termed an internal or discontinuous phase.

The emulsification temperature is the temperature at which emulsification takes place. The emulsification temperature must satisfy the requirements that:

(1) it is below the degradation temperature of the materials in the system;

(2) it is below the boiling point of both the external and internal phases;

(3) it is above the solidification temperature of both phases; and (4) it is above the critical temperature.

As a practical matter under manufacturing conditions, the emulsification temperature range is preferably between five and ten degrees above the minimum emulsification temperature which meets the foregoing requirements. Alternatively, the emulsification temperature range may be from ambient temperature to about five degrees above ambient temperature, provided that all temperatures within this range meet the foregoing requirements.

The emulsification temperature is preferably the lowest temperature at ambient or above at which the low shear mixing equipment used may properly agitate the emulsion without undue strain. Also, the emulsification temperature should be the minimum temperature at which the emulsion may be mixed without permanent destruction of the gel matrix.

The solidification temperature is the temperature at which one or both phases begin to solidify. The solidification temperature is quite close to the critical temperature, and can be used as an approximation of the critical temperature. The solidification temperature is generally above the critical temperature if the solidification temperature is defined as the temperature when haziness of the phase first develops during cooling. The solidification temperature is below the critical temperature if it is defined as the temperature at which the phase completely solidifies. Quite commonly, the solidification point is defined as the cloud point of the discontinuous phase.

In the practice of the invention, the discontinuous phase is prepared by combining all of the components which are soluble in that phase and heating those components to form a solution. A nonionic emulsifier, preferably to the extent of between about 15 and 35 percent by weight of the colloid thickening agent, is added to the discontinuous phase. The emulsifier selected must be soluble in both the continuous and discontinuous phases and must not be degraded or inactivated by the other components of either of those phases. Also, the emulsifier must not interfere with the efficacy or stability of the final product. Once the discontinuous phase is uniform, it is heated, or cooled if necessary, to the emulsification temperature range. The insoluble components, such as pigments are added and dispersed within the discontinuous phase. In addition, the colloid thickening agent, or at least one reactive component thereof, is added and dispersed in the discontinuous phase.

The continuous phase is prepared by combining all of the components which are soluble in that phase. If necessary, heat is applied to promote formation of the solution. Once the continuous phase is uniform, it is heated, or cooled if necessary to the emulsification temperature range.

Low shear mixing is performed in the vessels containing the separated discontinuous and continuous phases while those phases are maintained within the emulsification temperature range. The mixing rate for the discontinuous phase must be sufficient to keep particles dispersed. The mixing rate for the continuous phase must be high enough to keep that phase uniform and to enable emulsification to take place at the rate at which the discontinuous phase will be added to the continuous phase. The mixing rate for the continuous phase is dependent upon several variables, including the rate at which the discontinuous phase is added, the affinity of the colloid thickener for the continuous phase, and the final viscosity of the completed emulsion.

Mixing of both the discontinuous phase and the continuous phase is continued separately while the discontinuous phase is added to the continuous phase. As the discontinuous phase is added, the colloid thickening agent, or component thereof, which has been dispersed in the continuous phase precipitates out into the continuous phase and begins to form a lattice structure. The emulsifier which was added to the discontinuous phase will have decreased the surface tension around the colloid thickener or thickener component so that the presence of the continuous phase around the colloid does not hamper development of the gel. An incidental benefit is that the colloid material has been dispersed in the discontinuous phase, thus allowing the individual particles of the thickener to swell up without interfering with each other, thereby actually decreasing the gel preparation time.

Low shear mixing is continued while the discontinuous water immiscible phase is added to the continuous aqueous phase. Low shear mixing is continued even after the discontinuous phase has been completely added to the continuous phase. As low shear mixing continues, the product begins to acquire a smooth, uniform texture as the colloid thickening agent continues the development of the lattice structure. Low shear mixing is continued as the batch is cooled down to the critical temperature or to ambient temperature before mixing is discontinued, whereupon the batch is complete.

Where the product is to be fragranced with perfume, perfume oil can be added as the phases are mixed together, or it may be added to the water immiscible discontinuous phase prior to adding the discontinuous phase to the aqueous phase if the perfume oil is heat stable. In this event, the perfume oil should be added to the discontinuous phase immediately prior to emulsification to assure maximum distribution and to minimize degradation of the perfume oil.

The method of the invention may be practiced with either single component colloid thickeners or with thickeners formed of a plurality of reactive components. Suitable single component thickening agents include xanthan gum, methylcellulose, hydroxypropyl methylcellulose, sodium carboxymethylcellulose and such derivatives of natural products as carageenan and guar gum, as well as other similar products.

Thickening agents comprised of a plurality of reactive components may also be employed. Where the thickener is comprised of a plurality of reactive components, at least one of these components is dispersed in the water immiscible phase, and at least another of the reactive components is dispersed within the aqueous phase prior to adding the water immiscible phase to the aqueous phase.

Suitable multicomponent thickeners include acrylic acid polymers, otherwise known as carbomers, which are neutralized with an alkaline material such as triethanolamine or sodium hydroxide. Carbomers which are particularly suitable for use as in multipart thickening agents in the manufacturing process of the invention include Carbomer 934, Carbomer 940, Carbomer 941 and Carbomer 1342. Carbomers and polyvinyl alcohol simplify the emulsification process with the result that the emulsion is much more stable, the particle size of the discontinuous phase is smaller without the aid of milling or homogenizing equipment, and emulsification of the product can be carried out at lower temperatures.

Polyvinyl alcohol can be gelled using such material as sodium borate decahydrate, boric acid and some organic materials. In many respects, polyvinyl alcohol emulsions are similar to carbomer emulsions. They are gelled using a two component system, namely a polymer and a neutralization gelling agent. It is easier to disperse the polymer in the aqueous phase than in the oil phase. Under proper conditions, polyvinyl alcohol emulsions are as stable as carbomer emulsions.

Carboxypropyl hydroxypropyl guar may be used in a manner similar to polyvinyl alcohol and gelled with a sodium borate decahydrate solution, or by itself. Carboxypropyl hydroxypropyl guar behaves in a manner similar to hydroxypropyl methylcellulose. The high affinity of the guar derivatives for water can be used advantageously by dispersing the guar derivative in the oil phase and using it in the same manner as the hydroxypropyl methylcellulose.

Xanthan gum offers several advantages over multiple component carbomers. Specifically, xanthan gum is less sensitive to sodium ions than are carbomers. At sodium salt concentrations over 2%, on a dry weight basis, most carbomers will begin to precipitate out of solution. However, in the same salt concentrations xanthan gum is still active and suspends particles in the aqueous phase. Also, since xanthan gum hydrates in water and does not require neutralization, the problem of material incompatibility is decreased. Xanthan gum is readily available as a fine powder, which is a very desirable grade for use in the process of the invention. Xanthan gum is compatible with other suspending agents such as hydroxypropyl methylcellulose.

Xanthan gum does have some disadvantages, however. At concentrations above 0.3% by weight xanthan gum gels, and feels tacky and gummy on application. Also, it is very difficult to develop a xanthan gum emulsion which has a viscosity of over 6,000 centipoise. While xanthan gum lotions are quite popular, it is very difficult to develop a straight xanthan gum emulsion, where xanthan gum is the sole thickening agent, with a viscosity which rivals a Carbomer 940 based cream.

Hydroxypropyl methylcellulose is one example of the cellulose ethers which are available for use as a single component thickening agent in the process of the invention. When used in conjunction with xanthan gum to suspend oils, the hydroxypropyl methylcellulose helps to minimize the application problems of xanthan gum, and depending on the grade, will help increase the viscosity of the emulsion. Hydroxypropyl methylcellulose is an excellent suspension agent by itself if the properties of the water immiscible phase are correct. However, if hydroxypropyl methylcellulose gels are used without structural reinforcement for the emulsion, the gel will eventually collapse, thus resulting in phase separation.

In an emulsion, the hydroxypropyl methylcellulose will emulsify the oils. However, if the oil phase is a liquid, the gel will gradually float to the surface, as it is drawn up by the oil phase buoyancy. Also, it will be compressed if the oil phase is a fluid. If the oil phase cools and solidifies before the buoyancy of the oil phase pulls excessively on the gel, the solid oil phase particles will reinforce the hydroxyproplyl methylcellulose gel.

Many thickeners, such as magnesium aluminum silicate, bentonite, hectorite and others which might be considered are not suitable for use in the process of the invention. One of the prerequisites of the thickener employed is that it is hydrophilic. That is, it must have a very high affinity for the aqueous phase, so that upon phase inverion, the hydrated thickener will have entrapped small droplets of the oil or wax phase within its matrix. Inorganic thickeners are generally thixotropic in nature. That is, the particles of such thickeners have a higher affinity for each other than for water. The mechanism by which they can be used to stabilize emulsions involves high shear which is used to develop the matrix.

Under high shear, the plates of the thickener are separated, and will generally develop a three dimensional lattice structure which is stable if the droplets of oil which have become trapped in the lattice structure solidify and stabilize the gel. This mechanism explains the gradual separation noticed in thixotropic gels over time, which is contrary to the expected stability of such gels over time. With the lapse of time, the lattice structure tends to fold back on to itself and squeeze out some of the material between the plates. This occurs because the platelets of the gel structure have a higher affinity for each other than for the continuous or aqueous phase.

Deionized water is preferably used to form the aqueous phase. Deionized water is a chemical form of distilled water from which virtually all minerals have been removed. The use of deionized water is not mandatory, but is preferred so as to provide a greater degree of control over the major raw materials. Properly deionized water is fairly consistent from batch to batch with respect to its pH, mineral content, conductivity and other properties.

A wide variety of oils and waxes may be selected for use as a component or components immiscible in the aqueous phase. Animal fats and oils may be utilized for this purpose. Examples of such materials include shark liver oil, orange roughy oil, cod liver oil, butter fat and beef tallow. Vegetable fats and oils may also be used in the immiscible phase. Among the suitable vegetable fats and oils are jojoba oil, almond oil, olive oil, wheat germ oil, sesame oil, rice bran oil, camellia oil, avacado oil, peanut oil, coconut oil, cocoa butter, and palm oil. Ester oils, such as hexyl laurate, butyl stearate, octyldodecyl myristate, triisopropyl adipate, behenyl erucate, tocopheryl acetate, diisopropyl adipate, erucyl erucate, isostearyl erucyl erucate and diisopropyl sebacate may likewise be utilized. Silicone oils, such as dimethyl polysiloxane and cyclomethicone may also serve as components immiscible in the aqueous phase, as may terpenoids, such as orange oil, lemon oil, citrus oil, jasmine oil and ethylene brassylate.

Waxes may also be used as components which are immiscible in the aqueous phase. Suitable waxes include carnuba wax, ozokerite, rice bran wax and beeswax. Ester waxes may also be utilized, such as C18–36 triglycerides and hydrogenated jojoba oil.

Higher aliphatic hydrocarbons may also be utilized as components which are immiscible in the aqueous phase. Suitable higher aliphatic hydrocarbons include liquid paraffin, mineral oil, petrolatum, ceresin, polythylene homopolymers, squalane, hydrogenated polyisobutene. Other immiscible components which may be utilized include benzene and naphthalenic compounds, which are generally referred to as "aromatic" compounds due to the presence of the benzene ring within the structure of the molecule. Among these compounds which may be used as suitable water immiscible components are octocrylene, octyl dimethyl para-aminobenzoic acid, butylated hydroxyanisole, butylated hydroxytoluene, tocopheryl acetate and retinol.

Higher fatty acids may also serve as components which are immiscible in the aqueous phase. Suitable fatty acids include lauric acid, myristic acid, stearic acid, palmitic acid, behenic acid and lanolin fatty acid. Higher alcohols such as lauryl alcohol, stearyl alcohol, cetyl alcohol, myristyl alcohol, behenyl alcohol, synthetic alcohol and C18–40 alcohol may also be utilized as components which are immiscible in the aqueous phase.

At the time that the water immiscible phase is added to the aqueous phase, the temperature of both of the phases may be raised above ambient temperature. The advantage of elevating the temperature is that the viscosity of the emulsion is generally less at higher temperatures, especially if the melting point of the oil or wax phase is above ambient temperature. This allows better agitation of the batch during the emulsification process, and thus a better dispersion of the oil phase without upgrading the equipment used.

The emulsifier utilized in the process of the invention is selected so as to minimize the quantity of emulsifier employed. In any event, emulsifier should be present to no greater than 50%, by weight of the amount of the thickener in the emulsion. Preferably, the emulsifier is present to the extent of between about 15 and 35%, by weight, of the thickener. Sorbitan oleate and Polysorbate 80 are used as emulsifiers to minimize the amount of emulsifier required to disperse the thickener or the liquid component of a multicomponent thickener, such as sodium borate decahydrate solution, triethanolamine, and beta-alanine solution. For very dry materials, such as Carbomer 940, polyvinyl alcohol, hydroxypropyl methylcellulose and xanthan gum, the emulsifiers are adsorbed onto the surfaces of the particles of thickening agent. This facilitates the absorption of water during emulsification and allows the thickening agent to hydrate and form the gel matrix.

As with the conventional manufacture of emulsions, the use of preservatives may be desirable. For example, methylparaben, imidazolidinyl urea, propylparaben and proplylene glycol are particularly suitable for use in cosmetic emulsions. Other materials may be selected as preservatives, depending upon the desired function of the product and the suitability of the preservative in the product. For example, formaldehyde, diazolidinyl urea and phenol may also be used as preservatives in certain emulsifier applications.

The maximum level of emulsifier and neutralizing agent for the hydrophillic thickener is determined both by the upper limits of the maximum workable and usable viscosity of the emulsion, and by the deleterious effects which the emulsifier or neutralizing agent may have upon other components of the emulsion, such as the preservatives. The minimum levels of the emulsifier and neutralizing agent are determined by the desired viscosity of the emulsion, the desired storage period of the emulsion and the melting point of the oil or wax phase.

The critical difference between conventional manufacturing processes for producing emulsions and the manufacturing process of the invention is that the improved process of the invention minimizes the quantities of both the emulsifier and the thickener which are employed and utilizes the phase inversion of the oil or wax phase containing the thickening agent to reduce the particle size of the oil or wax phase. This phase inversion occurs as a result of adding the oil or wax phase to the aqueous phase. Since the emulsifier level in the oil or wax phase is insufficient to dissolve the aqueous phase in the oil or wax phase, the thickening agent is drawn out of the oil or wax phase at the interface. The gellant then encapsulates or surrounds the oil or wax phase. As the aqueous phase is mixed, the oil or wax droplets are broken into smaller sizes, thereby exposing more thickening agent. This breakdown continues until most of the thickening agent has been expended, and the oil or wax droplets or particles have reached a minimal size, thus ensuring maximum stability of the emulsion.

The rate at which phase inversion occurs will have a direct bearing on the particle size and the uniformity of distribution of the water immiscible phase. The greater the rate of phase inversion, the smaller will be the emulsion particle size, and the greater will be the uniformity of distribution. If the dispersed material in the oil phase is a liquid, the finer the dispersion the greater the uniformity of the water immiscible phase. If the dispersed material is dry, and does not dissolve in the oil phase, the uniformity of distribution will be dependent on the particle size of the dry material and the ease with which it is dispersed in the oil phase.

The invention may be described with greater clarity and particularity by reference to certain, illustrative examples.

EXAMPLE 1

A quantity of an aqueous phase is prepared in a first vessel by carefully dispersing 0.30 parts by weight of Carbomer 940 in 50 parts by weight of deionized water. If the carbomer is added to the water too quickly, or if it has been stored under moist conditions, the mixing time will be increased. In a second separate vessel a quantity of a water immiscible phase is prepared. Between about 1.50 and 27.8 parts by weight of isopropyl myristate are combined with 0.09 parts sorbitan oleate, 0.09 parts Polysorbate 80 and 0.45 parts triethanolamine (99%). These components of the water immiscible phase are mixed together until the mixture is uniform and the triethanolamine is completely dispersed.

Low shear mixing of the aqueous and water immiscible phases is continued separately in the respective vessels containing the quantities of these phases. The water immiscible phase is slowly added to the aqueous phase while low shear mixing is continued. As the viscosity of the combined phases increases, the mixing speed must be increased to properly incorporate the water immiscible phase into the aqueous phase. The water immiscible phase is continuously added until it has been completely incorporated into the aqueous phase. Low shear mixing is continued until the emulsion is uniform. Thereafter, additional parts of deionized water are added to bring the emulsion to a total of 100 parts by weight. Caution is exercised to ensure that the emulsion is not overmixed.

EXAMPLE 2

The process of Example 1 is repeated except that the quantities of certain of the components are varied from those of Example 1 as follows: Carbomer 940—1.25 parts by weight; sorbitan oleate—0.30 parts by weight; Polysorbate 80—0.30 parts by weight; and triethanolamine—1.25 parts by weight.

EXAMPLE 3

A quantity of an aqueous phase is prepared in a first vessel by mixing 0.45 parts by weight of triethanolamine (99%) in 50 parts by weight of deionized water. A water immiscible phase is prepared in a second vessel by mixing from about 1.5 to about 27.8 parts by weight of isopropyl myristate, 0.10 parts by weight of propylparaben, 0.06 parts by weight of sorbitan oleate, 0.06 parts by weight of Polysorbate 80 and 0.3 parts by weight of Carbomer 940 with low shear. Mixing of the water immiscible phase is continued until the carbomer is completely dispersed. The carbomer is insoluble and will gradually settle out when mixing is stopped.

While low shear mixing of the water immiscible phase is continued, the water immiscible phase is slowly added to the aqueous phase. As the viscosity of the combined phases increases, the mixing speed must be increased to properly incorporate the oil phase into the aqueous phase. The oil phase is continuously added until it has been completely incorporated into the aqueous phase. Low shear mixing is continued until the emulsion is uniform. Thereafter, deionized water is added to the extent necessary to bring the total emulsion up to 100 parts by weight. Mixing is continued until the emulsification is uniform.

EXAMPLE 4

The steps of Example 3 are repeated except that quantities of certain of the components of Example 3 are altered from those employed in Example 3 to the following: triethanolamine—3.75 parts; sorbitan oleate—0.30 parts; Polysorbate 80—0.30 parts; and Carbomer 940—1.25 parts. Also, no propylparaben is utilized in this example.

EXAMPLE 5

A quantity of an aqueous phase is prepared in a first vessel by mixing 1.00 parts by weight of polyvinyl alcohol in 50 parts by weight of deionized water. In a separate vessel, between 1.50 and 27.80 parts by weight of isopropyl myristate, 0.03 parts by weight of sorbitan oleate, 0.03 parts by weight Polysorbate 80 and 0.15 parts by weight of a 40% borax solution in glycerol are mixed together into a uniform mixture to form a quantity of a water immiscible phase. Mixing is continued until the borax is completely dispersed.

Low shear mixing of both the aqueous and water immiscible phases is continued while the water immiscible phase is slowly added to the aqueous phase. As the viscosity of the combined phases increases, mixing speed must be increased to properly incorporate the water immiscible phase into the aqueous phase. The water immiscible phase is continuously added until it has been completely incorporated into the aqueous phase. Mixing is continued until the emulsion is uniform. Deionized water is added to bring the composite weight of the resulting emulsion up to 100 parts by weight. Caution is exercised to prevent overmixing.

EXAMPLE 6

The steps of Example 5 are repeated except that quantities of certain of the components of Example 5 are altered from those employed in that example to the following: polyvinyl alcohol—2.36 parts by weight; sorbitan oleate—0.40 parts by weight; Polysorbate 80—0.40 parts by weight and 40% borax solution in glycerol—0.83 parts by weight.

EXAMPLE 7

A quantity of an aqueous phase is prepared in a first vessel by dissolving 0.06 part by weight of borax in 50 parts deionized water. A quantity of a water immiscible phase is prepared in a second vessel by mixing together between 1.50 and 27.80 parts by weight of isopropyl myristate, 0.10 parts by weight propylparaben, 0.20 parts sorbitan oleate, 0.20 parts Polysorbate 80 and 1.00 parts polyvinyl alcohol. Low shear mixing of the components of the water immiscible phase is continued until the mixture is uniform and the polyvinyl alcohol is completely dispersed. The polyvinyl alcohol is insoluble and will gradually settle out if mixing is stopped.

The quantity of the water immiscible phase is then slowly added to the aqueous phase in the first vessel. As the viscosity of the combined phases increases, mixing speed is increased to properly incorporate the water immiscible phase into the aqueous phase. The water immiscible phase is continuously added until it has been completely incorporated into the aqueous phase. The deionized water is added as necessary to bring the emulsion up to 100 parts by weight. Mixing is continued until the emulsion is uniform.

EXAMPLE 8

The steps of Example 7 are repeated except that quantities of certain of the components of Example 7 are altered from those employed in that example to the following: borax—0.15 parts; sorbitan oleate—0.50 parts; Polysorbate 80—0.50 parts; and polyvinyl alcohol—2.36 parts by weight. Also, no propylparaben is utilized in this example.

EXAMPLE 9

A quantity of a water immiscible phase is prepared in a first vessel by mixing together with low shear between about 1.50 and about 27.80 parts by weight of isopropyl myristate with 0.06 parts sorbitan oleate, 0.06 parts Polysorbate 80 and 0.30 parts xanthan gum. Mixing is continued with low shear until the mixture is uniform and the xanthan gum is completely dispersed within the mixture in the first vessel. The xanthan gum is insoluble in the liquid and will settle out if mixing is halted.

While low shear mixing of the water immiscible phase continues, the contents of the first vessel are slowly added to a second vessel which contains about 50.0 parts by weight of an aqueous phase. In this example the aqueous phase is comprised totally of deionized water. As the water immiscible phase of the first vessel is added to the aqueous phase of the second vessel, viscosity of the combined phases increases, and mixing speed must be increased to properly incorporate the water immiscible phase into the aqueous phase. The water immiscible phase is added to the aqueous phase until it has been completely incorporated into the aqueous phase. An additional quantity of deionized water is added to the emulsion to bring the total emulsion weight up to 100 parts by weight. Low shear mixing is continued until the emulsion is uniform.

EXAMPLE 10

The steps of Example 9 are repeated except that quantities of certain of the components of Example 9 are altered from those employed in that example to the following: sorbitan oleate—0.50 parts by weight; Polysorbate 80—0.50 parts and xanthan gum—2.50 parts by weight.

EXAMPLE 11

The steps of Example 9 are repeated except that methylcellulose is substituted for the xanthan gum.

EXAMPLE 12

The steps of Example 10 are repeated with the exception that methylcellulose is substituted for the xanthan gum.

EXAMPLE 13

The steps of Example 9 are repeated except that hydroxypropyl methylcellulose is substituted for the xanthan gum.

EXAMPLE 14

The steps of Example 10 are repeated with the exception that hydroxypropyl methylcellulose is substituted for the xanthan gum.

EXAMPLE 15

The steps of Example 9 are repeated with the exception that carboxymethyl hydroxypropyl guar is substituted for the xanthan gum.

EXAMPLE 16

The steps of Example 10 are repeated except that carboxymethyl hydroxypropyl guar is substituted for the xanthan gum.

EXAMPLE 17

The quantity of an aqueous phase is prepared in a first vessel by mixing 0.08 parts by weight of borax with low shear in 50.00 parts by weight of deionized water. A quantity of a water immiscible phase is prepared in a second vessel by mixing together between about 1.50 and 27.80 parts by weight isopropyl myristate, about 0.06 parts sorbitan oleate, about 0.06 parts Polysorbate 80 and about 0.30 parts by weight carboxymethyL hydroxypropyl guar. Low shear mixing of the water immiscible phase is continued until the mixture is uniform. Carboxymethyl hydroxypropyl guar is insoluble in the liquid and will settle out if mixing is stopped.

The low shear mixing of the water immiscible phase is continued while the water immiscible phase is slowly added to the aqueous phase. Low shear mixing of the aqueous phase is also continued. As the viscosity of the combined phases increases, the mixing speed of the combined phases must be increased to properly incorporate the water immiscible phase into the aqueous phase. While mixing is continued, additional deionized water is added to bring the total weight of the emulsion up to 100 parts. Mixing is continued until the emulsion is uniform.

EXAMPLE 18

The steps of Example 17 are repeated except that the quantities of some of the components are varied from the quantities employed in that example as follows: borax—0.63 parts; sorbitan oleate—0.50 parts; Polysorbate 80—0.50 parts; and carboxymethyl hydroxypropyl guar—2.17 parts.

EXAMPLE 19

A quantity of an aqueous phase is prepared in a first vessel by carefully dispersing 0.50 parts by weigh of Carbomer 940 in 50.00 parts by weight of deionized water. Carbomer 940 is very hygroscopic. If it is added to the water too quickly, or if it has been stored under moist conditions, mixing time will be increased.

0.50 parts allantoin, 0.20 parts methylparaben, 0.30 parts imidazolidinyl urea and 5 parts propylene glycol are added to the mixture in the first vessel and mixed with low shear until the entire aqueous phase is uniform. It should be noted that allantoin has limited solubility in water. At 25 degrees Celsius the maximum solubility of allantoin is approximately 0.50 percent. Therefore, some of the allantoin will be suspended in the carbomer gel.

A quantity of a water immiscible phase is prepared in a separate second vessel. To prepare the water immiscible phase, between 1.50 and 27.8 parts by weight of isopropyl myristate and 0.10 parts propylparaben are combined. The mixture is stirred with low shear until the propylparaben has been dissolved. 0.15 parts sorbitan oleate and 0.15 parts Polysorbate 80 are then added and mixed with low shear until the solution is uniform. 0.75 parts of triethanolamine (99%), is then added to the other components of the water immiscible phase, and the mixture is stirred until the triethanolamine has been dispersed. 0.10 parts of wheat germ oil are then quickly added and mixed in.

Low shear mixing of both the aqueous phase and the water immiscible phase is continued separately. The water immiscible phase is then slowly added to the aqueous phase. As the viscosity of the combined phases increases the mixing speed must be increased to properly incorporate the water immiscible phase into the aqueous phase. The water immiscible phase is added until it has been completely incorporated in the aqueous phase. Low shear mixing is continued until the resulting emulsion is uniform.

If the temperature is greater than 50 degrees Celsius, then the emulsion should be cooled down to 50 degrees Celsius, or below, before proceeding. Once the emulsion is complete, it is prudent not to overmix, since the viscosity of the emulsion is such that it is not a freely flowing liquid. Therefore, any air that is incorporated in the emulsion will be trapped.

Once the emulsion is at 50 degrees Celsius or below, 0.10 parts by weight of aloe vera gel is added, and additional deionized water is also added to the emulsion to the extent necessary to bring the total weight of the emulsion up to 100 parts. The additional deionized water is fully mixed in, still at low shear. Since the emulsion is an oil-in-water emulsion and the aloe vera gel and the additional deionized water are compatible with the aqueous phase, the emulsion will accept the addition of the aloe vera gel and the additional deionized water without adverse effects on the stability of the emulsion.

EXAMPLE 20

A quantity of an aqueous phase is prepared in a first vessel by dispersing 0.75 parts by weight of triethanolamine, 0.50 parts allantoin, 0.20 parts methylparaben, 0.30 parts imidazolidinyl urea and 5.0 parts propylene glycol in 50 parts by weight of deionized water. These materials are mixed until the consistency of the aqueous phase is uniform.

In a second vessel, a water immiscible phase is prepared by combining between 1.50 and 27.80 parts isopropyl myristate and 0.10 parts propylparaben. This mixture is stirred until the propylparaben is dissolved. To the propylparaben solution 0.10 parts sorbitan oleate and 0.10 parts Polysorbate 80 are added and mixed in until the solution is uniform. To this solution, 0.50 parts Carbomer 940 is added, and the mixture is stirred until the Carbomer 940 has been dispersed. It should be noted that the Carbomer 940 is insoluble in the oil phase, and will settle out upon cessation of agitation. 0.10 parts wheat germ oil is then added to complete the water immiscible phase.

Both the water immiscible phase and the aqueous phase are continuously mixed at low shear in their respective containers while the water immiscible phase is added to the aqueous phase. As the viscosity of the combined phases increases, the mixing speed must be increased to properly incorporate the water immiscible phase into the aqueous phase. The entire quantity of the water immiscible phase is added to the aqueous phase and low shear mixing is continued until the emulsion is uniform. Since the Carbomer 940 must also hydrate while forming the gel structure, mixing must continue during the hydration process. Upon completion of hydration of the Carbomer 940 the emulsion will no longer contain small, hazy lumps of gel formed by partially hydrated carbomer, but will appear smooth and consistent.

If the temperature of the emulsion is greater than 50 degrees Celsius, it must be cooled down to that temperature, or below. Once the emulsion is 50 degrees Celsius or less, 0.10 parts aloe vera gel and an additional quantity of deionized water, sufficient to bring the total weight of the emulsion up to 100 parts, are added to the mixing vessel containing the emulsion and are gently mixed in.

EXAMPLE 21

The steps of Example 20 are repeated with the exception that the compositions of the quantities of the aqueous phase and the water immiscible phase, in the first and second vessels, respectively, are as follows: aqueous phase—50 parts deionized water; 0.50 parts allantoin; 0.20 parts methylparaben; 0.30 parts imidazolidinyl urea and 5.00 parts propylene glycol; water immiscible phase—1.50 to 15.00 parts isopropyl myristate; 0.10 parts propylparaben; 0.10 parts sorbitan oleate; 0.10 parts Polysorbate 80; 0.30 parts xanthan gum; 0.20 parts hydroxypropyl methylcellulose; and 0.10 parts wheat germ oil.

EXAMPLE 22

The steps of Example 21 are carried out with the exception that only 0.06 parts each of sorbitan oleate and Polysorbate 80 are employed, and no hydroxypropyl methylcellulose is employed in the emulsion.

EXAMPLE 23

The steps of Example 21 are performed, with the exception that a quantity of a water immiscible phase having the following composition substituted for the water immiscible phase employed in Example 21: water immiscible phase—between 1.50 and 10 parts by weight isopropyl myristate; 3.00 parts cetyl alcohol, USP; 0.10 parts propylparaben; 0.10 parts sorbitan oleate; 0.10 parts Polysorbate 80; 0.5 parts hydroxypropyl methylcellulose and 0.10 parts wheat germ oil.

EXAMPLE 24

The steps of Example 20 are repeated except that in the water immiscible phase no more than 10 parts of isopropyl myristate are employed and 5.0 parts of micronized iron oxide or other pigment are incorporated into the water immiscible phase.

EXAMPLE 25

The steps of Example 19 are repeated except that in the water immiscible phase no greater than 10 parts of isopropyl myristate are employed. Also, the water immiscible phase additionally includes 0.75 parts hydrated silica and 5.0 parts micronized iron oxide.

EXAMPLE 26

The steps of Example 21 are repeated with the exception that no more than 10 parts isopropyl myristate are employed in the water immiscible phase. Also, the water immiscible phase additionally includes 2.00 parts micronized iron oxide and 0.40 parts hydrated silica.

EXAMPLE 27

The steps of Example 21 are repeated except that in the aqueous phase 2.0 parts by weight of polyvinyl alcohol are substituted for the propylene glycol used in Example 21. Also, in the water immiscible phase sorbitan oleate and Polysorbate 80 are each employed to the extent of only 0.06 parts, the hydroxypropyl methylcellulose is omitted entirely, and 0.30 parts of a solution of sodium borate decahydrate are substituted for the xanthan gum. The sodium borate solution is a weight to weight solution of 40% borate in glycerol.

EXAMPLE 28

The steps of Example 21 are repeated with the exception that the aqueous phase is additionally comprised of 0.12 parts by weight of sodium borate decahydrate. Also, the concentration of sorbitan oleate and Polysorbate 80 is increased to 0.40 parts each 2.00 parts of polyvinyl alcohol are additionally included in the water immiscible phase, and both the xanthan gum and the hydroxypropyl methylcellulose are deleted from the water immiscible phase entirely.

EXAMPLE 29

The steps of Example 28 are repeated with the exception that the concentration of sodium borate decahydrate in the aqueous phase is reduced to 0.10 parts. Also, in place of the water immiscible phase employed in Example 28, a water immiscible phase having the following composition is employed: between 1.50 and 15.00 parts cetyl ricinoleate, 0.10 parts propylparaben, 0.26 parts sorbitan oleate, 0.26 parts Polysorbate 80, 1.00 parts carboxymethyl hydroxypropyl guar, 0.30 parts hydroxypropyl methylcellulose, and 0.10 parts wheat germ oil.

EXAMPLE 30

The steps of Example 20 are repeated with the exception that 1.20 parts beta-alanine are substituted for the triethanolamine in the aqueous phase.

EXAMPLE 31

The steps of Example 19 are repeated with the exception that isopropyl myristate is present in the water immiscible phase to the extent of only 5 parts by weight, and the water immiscible phase additionally includes 3.00 parts cetyl alcohol. Also, 5.0 parts of a 1% aqueous solution of soluble collagen are substituted for the aloe vera gel used in Example 19.

Undoubtedly, numerous variations and modifications of the invention will become readily apparent to those familiar with the manufacture of emulsions. For example, the invention has been described with reference to emulsions utilized in the cosmetic and toiletry industry. However, the invention may also be applied to the manufacture of pharmeceuticals, paints and other emulsion products in various diverse fields of industry. Accordingly, the scope of the invention should not be construed as limited to the specific examples described above, but rather is defined in the claims appended hereto.

I claim:

1. A method of manufacturing emulsions from discontinuous and continuous phase constituents comprising:

forming a liquid discontinuous phase emulsion constituent by mixing together into a uniform dispersion quantities of an emulsifier, an oil which is immiscible in water, and at least one component of a multi-component hydrophilic colloid thickener system in the absence of water, wherein the ratio of the weight of said emulsifier to that of said thickener component is no greater than about 0.50 to 1 and wherein the weight of said thickener system in the total weight of all constituents is no greater than 2.5 percent, combining said discontinuous phase emulsion constituent with a liquid continuous phase emulsion constituent that includes water and all the other components of said thickener system while mixing said discontinuous and continuous phase constituents together with low shear at least until the occurrence of phase inversion wherein said thickener is neutralized and gels as an emulsion is formed.

2. A method of manufacturing emulsions from discontinuous and continuous phase constituents comprising:

forming a liquid discontinuous phase emulsion constituent by mixing together into a uniform dispersion quantities of an emulsifier, an oil which is immiscible in water, and a single component hydrophilic colloid thickener in the absence of water, wherein the ratio of the weight of said emulsifier to that of said thickener is no greater than about 0.50 to 1 and wherein the weight of said thickener in the total weight of all constituents is no greater than 2.5 percent, combining said discontinuous phase emulsion constituent with a liquid continuous phase emulsion constituent that includes water while mixing said discontinuous and continuous phase constituents together with low shear at least until the occurrence of phase inversion and until said thickener hydrates and gels as it forms an emulsion.

3. A method according to claim 2 wherein the ratio of the weight of said emulsifier to that of said thickener is no greater than about 0.35 to 1.

4. A method according to claim 3 wherein the ratio of the weight of said emulsifier to that of said thickener is between about 0.15 to 1 and about 0.35 to 1.

5. A method of manufacturing emulsions of a water immiscible phase in an aqueous phase comprising:

liquefying a constituent which is immiscible in said aqueous phase and adding thereto at least one thickening agent component of a multi-component hydrophilic thickening agent system in the absence of water, wherein the weight of said thickening agent system in the total weight of all constituents of both said water immiscible phase and said aqueous phase is no greater than 2.5 percent, and a nonionic emulsifier to the extent of a maximum of about 50 percent by weight of said thickening agent component and dispersing said thickening agent component and said emulsifier within said constituent which is immiscible in said aqueous phase to form said water immiscible phase, forming said aqueous phase to include all remaining components of said multi-component thickening agent system, liquefying said aqueous phase, mixing both of said phases with low shear while combining said water immiscible phase with said aqueous phase until phase inversion wherein gelation occur as said thickening agent system is neutralized and as an emulsion is formed, and mixing said phases together with low shear while reducing the temperature thereof at least until said water immiscible phase begins to solidify within said aqueous phase.

6. A method according to claim 5 further comprising adding a perfume component while mixing said phases together.

7. A method according to claim 5 further comprising adding a perfume component to said water immiscible phase prior to combining said water immiscible phase and said aqueous phase.

8. In a method of manufacturing using discontinuous and continuous phase constituents a cream having a water immiscible phase dispersed within an aqueous phase the improvement comprising separately preparing said water immiscible phase and said aqueous phase wherein the preparation of said water immiscible phase includes forming a uniform liquid dispersion of quantities of an emulsifier in the absence of water, a component which is immiscible in said aqueous phase and at least one reactive thickener component of a multiple component hydrophilic thickener system, wherein the ratio of weight of said emulsifier to that of said reactive thickener component is no greater than about 0.50 to 1, and wherein the weight of said total thickener system in the total weight of all constituents is no greater than 2.5 percent, combining said water immiscible phase with said aqueous phase while concurrently mixing said water immiscible phase and aqueous phase together with low shear until phase inversion occurs wherein said thickener is neutralized and gels as an emulsion is formed.

9. An improved method according to claim 8 wherein said thickener is comprised of a plurality of reactive components, at least one of which is dispersed in said water immiscible phase and at least another of which is dispersed within said aqueous phase prior to combining said water immiscible phase and said aqueous phase.

10. An improved method according to claim 8 wherein said reactive thickener component in said discontinuous phase constituent is a carbomer and at least one other of said multiple components in said hydrophilic thickener system is an alkaline neutralizing agent in said continuous constituent.

11. An improved method according to claim 8 wherein said component which is immiscible in said aqueous phase is comprised of an oil.

12. An improved method according to claim 8 wherein said component which is immiscible in said aqueous phase is comprised of a wax.

13. An improved method according to claim 8 further comprising cooling said emulsion following gellation to a critical temperature which is a temperature below which said component that is immiscible in said aqueous phase begins to solidify.

14. An improved method according to claim 8 wherein the ratio of weight of said emulsifier to that of said thickener is no greater than

15. An improved method according to claim 14 wherein the ratio of the weight of said emulsifier to that of said thickener is at least about 0.15 to 1.

* * * * *